US008764328B2

(12) United States Patent
Zhang et al.

(10) Patent No.: US 8,764,328 B2
(45) Date of Patent: Jul. 1, 2014

(54) PRINTABLE AUTOMATIC PAPER BELT-ROLLING READER (PB READER)

(76) Inventors: Yan Zhang, Weymouth, MA (US); Tianlan Zhang, Hangzhou (CN)

( * ) Notice: Subject to any disclaimer, the term of this patent is extended or adjusted under 35 U.S.C. 154(b) by 472 days.

(21) Appl. No.: 13/066,427

(22) Filed: Apr. 14, 2011

(65) Prior Publication Data

US 2011/0252991 A1 Oct. 20, 2011

Related U.S. Application Data

(60) Provisional application No. 61/324,037, filed on Apr. 14, 2010.

(51) Int. Cl.
*B41J 15/16* (2006.01)

(52) U.S. Cl.
USPC ..... 400/614; 400/583.3; 400/718; 40/347; 235/476; 235/481; 462/3; 462/46

(58) Field of Classification Search
USPC ..... 400/718.1; 40/347
See application file for complete search history.

(56) References Cited

U.S. PATENT DOCUMENTS 2,113,455 A * 4/1938 Sherman ..... 226/6
2,221,237 A * 11/1940 Goodloe ..... 40/347
2,747,465 A * 5/1956 Carden ..... 40/347
3,174,241 A * 3/1965 Rohan ..... 40/367
3,479,985 A * 11/1969 Morley ..... 40/518
3,882,620 A * 5/1975 Grindle ..... 40/347
3,983,651 A * 10/1976 Dickey ..... 40/347
4,083,136 A * 4/1978 Zelenko ..... 40/518
4,136,472 A * 1/1979 Delvo ..... 40/347
4,180,933 A * 1/1980 Chammah ..... 40/347
4,555,859 A * 12/1985 Corso ..... 40/471
4,703,953 A * 11/1987 Woods ..... 462/32
4,802,693 A * 2/1989 Brown ..... 281/7
5,515,631 A * 5/1996 Nardy et al. ..... 40/518

* cited by examiner

*Primary Examiner* — Jill Culler
(74) *Attorney, Agent, or Firm* — Kriegsman & Kriegsman

(57) ABSTRACT

The PB Reader solves the problem that the e-reader presents: the e-reader has a non-paper screen and printed documents need assembly, binding, and page turning via hands.

This is an electronic, mechanical device that can quickly search, review and print documents and that has text-to-speech and remote control functionality. The unit is rectangular in shape similar as a traditional book, including a viewing window for reading and printing. The unit is fed by two paper-belt rollers, across which images and printed text are displayed. The two paper-belt rolls, which are held by two square axles that are driven by the stepping motor through multiple reduction gears. A pattern of round dots is printed on the bottom side of the paper belt, which can be decoded by a photoelectric sensor to take action of reeling pages. The signals control the stepper motor, allowing the reader to reel the page forward or backward, or jump directly to a specific position.

The second component of this invention is the designated printer. Its body shape is rectangular. The said printer can print any text files and photos from a computer directly onto the blank paper belt in the PB Reader by means of sensing the code on the paper belt. This way, electronic files are transformed into physical paper files that are readable by the invention to ensure quick search, review and as well as safe storage.

The invention also has a wireless remote control function, which will allow people who are disabled (or users who for whatever reasons do not have free use of their hands) to make use of the reader.

17 Claims, 6 Drawing Sheets

PRINTABLE AUTOMATIC PAPER BELT-ROLLING READER (PB READER)

CROSS-REFERENCE TO RELATED APPLICATIONS

This application claims the benefits of U.S. Provisional Patent Application No. 61/324,037, filed Apr. 14, 2010, which is incorporated in its entirety by reference herein.

BACKGROUND OF THE INVENTION

1. Technology Field

This is an electronic, mechanical device with its main body composed of two paper scrolls (paper belt-rolls) that can quickly search, review and print documents with the feature of providing sound along with reading (Text-to-Speech feature) and remote control functionality, which traditional paper version books do not have.

The said device displays documents that are presented as text printed on a paper belt to provide the same satisfaction and closeness obtained from reading a traditional, paper-version book.

The said device is comprised of a Printable Automatic Paper Belt-Rolling Reader ("PB Reader") and a Designated Printer that can print text files and photos from a computer directly onto the blank paper belt in the PB Reader by means of sensing the code on the paper belt.

The PB Reader can also be connected to a computer to upload information onto an SDHC card which is inserted in the PB Reader. It can copy and delete documents that are on the SDHC card connected to the computer.

2. Background

Current electronic reader technology uses a digital signal display (as with an electrophoretic or similar displays called e-books), as opposed to letters/characters printed on paper.

This invention overcomes several problems associated with e-books. Such problems include (1) quick onset of eye-strain; (2) lack of the general satisfaction gained from holding a physical book such as using a pen/pencil to make highlights; (3) lack of accessibility and convenience for use by children; (4) high manufacturing costs.

The PB Reader also overcomes the need for turning pages of traditional books by hand. The PB Reader's designated printer eliminates the extra step of paper binding, as is done by traditional printers after documents are printed. The PB Reader presents the documents on a paper belt that is always printed already bound like a scroll.

In contrast to current e-books, the PB Reader uses the mechanical paper roll function and employs a printed paper display instead of using any electronic-digital display panel. (e.g., electrophoretic displays, electroactive displays, reflective bistable displays). Yet the PB Reader fulfills the e-book's functions such as moving pages forward, backward or skipping pages yet can be made at a much lower cost than e-books.

SUMMARY OF THE INVENTION

This is an electronic, mechanical device that can quickly search, review and print documents and that has text-to-speech and remote control functionality. The unit is rectangular in shape similar as a traditional book, including a viewing window for reading and printing. The unit is fed by two paper rolls, across which images and printed text are displayed. The two paper rolls are vertically placed into the rear part of the device's rectangular body: one roll is attached to left side and the other is attached to right side. (See FIG. 1)

The two paper rolls can be replaced with new rolls through opening the rear cover of the PB reader. The PB Reader has two paper-belt rolls, which are held by two square axles that are driven by the stepping motor through multiple reduction gears. A pattern of round dots is printed on the bottom side of the paper belt, which can be decoded by a photoelectric sensor to take action of reeling pages. The signals control the stepper motor, allowing the reader to reel the page forward or backward, or jump directly to a specific position.

The second component of this invention is the designated printer. Its body shape is rectangular. The said printer can print any text files and photos from a computer directly onto the blank paper belt in the PB Reader by means of sensing the code on the paper belt. This way, electronic files are transformed into physical paper files that are readable by the invention to ensure quick search, review and as well as safe storage.

With the text-to-speech and SDHC Card features in the invention, one can also use the PB Reader to make her/his own photo album with music at home. For example, a user can upload information from his/her computer onto an SDHC card. The SDHC card can be inserted into a PB Reader's SDHC card jack to allow an MP3 Audio file to play via speakers on the PB Reader.

The invention also has a wireless remote control function, which will allow people who are disabled (or users who for whatever reasons do not have free use of their hands) to make use of the reader.

This invention has applications in the following scenarios:

Electronic-Mechanical Teaching Books

Electronic-Mechanical Note Book (with a choice of setting up keys/passwords)

Electronic-Mechanical Calendar

Electronic-Mechanical Accounting Book (with a choice of setting up keys/passwords)

Electronic-Mechanical Music Notes

Electronic-Mechanical Map

Electronic-Mechanical Files

Electronic-Mechanical Braille books (with Dedicated Braille printing)

Electronic-Mechanical Photo Album

BRIEF DESCRIPTION OF THE DRAWINGS

These and other aspects of the invention will now be further described, by way of example only, with reference to the accompanying figures.

DETAILED DESCRIPTION OF A PREFERRED EMBODIMENT

We will describe an electronic mechanic Paper Belt-Rolling reading device ("PB Reader") composed of pages incorporating ink text-print displays, with an integrated printer and a remote controller.

Figure 1:
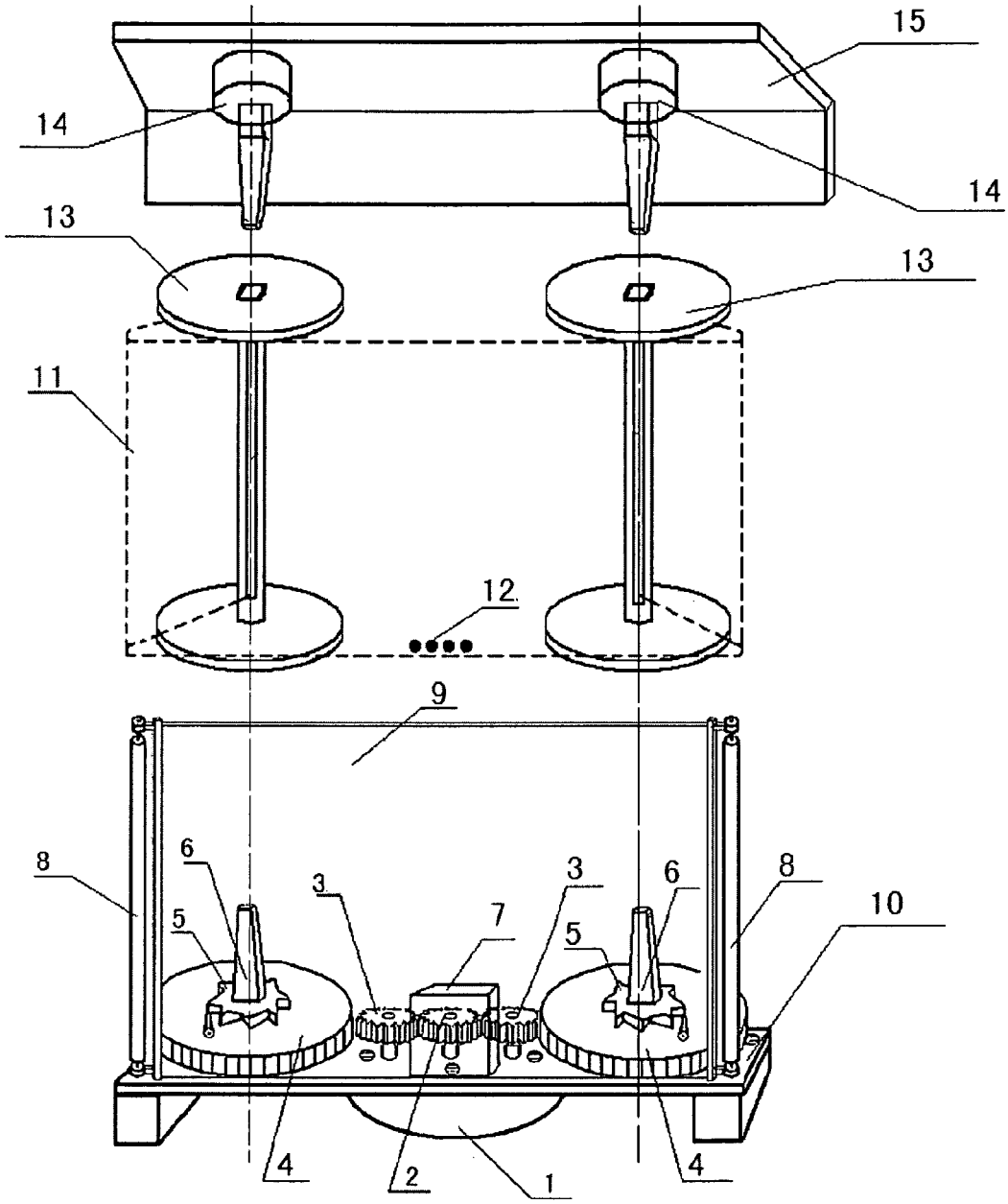
FIG. 1 shows a perspective view of a PB Reader's mechanical structure in accordance with the invention.

FIG. 1 shows a representation of the portable type PB Reader that has a fixed base 10. On the base there are two objective/active axles 6 on the left and right side (one axle on each side). In the center of the base 10, there is a motor gear 2 connected to two middle gears 3, which are linked to two big gears 4 with the decelerated ratio of 1:2:3.

The ratchet mechanisms 5 will automatically release the paper clip when the stepper motor 1 turns backwards.

The PB Reader has an enclosure decoder/photoelectric sensor 7 to decode the round-shape code 12 printed on the bottom of the paper belt 11 (which is represented as dash line on the drawing) controlled by digital circuits to enable the motor to reel the paper belt page forward or backward, stop, jump to a specific page.

The rollers 8 are made of nylon, with bearings inside to let the paper belt to pass smoothly. The paper holding board 9 is made of plastic to ensure the paper belt is taut, flat and smooth. The upper ⅔ part of the rear cover 15 of the PB reader can be removed to replace and install paper-belt rolls. There are two passive axles 14 on the top left and right sides of the back cover 15, which are used to fasten the paper-belt roll 13.

Figure 2:
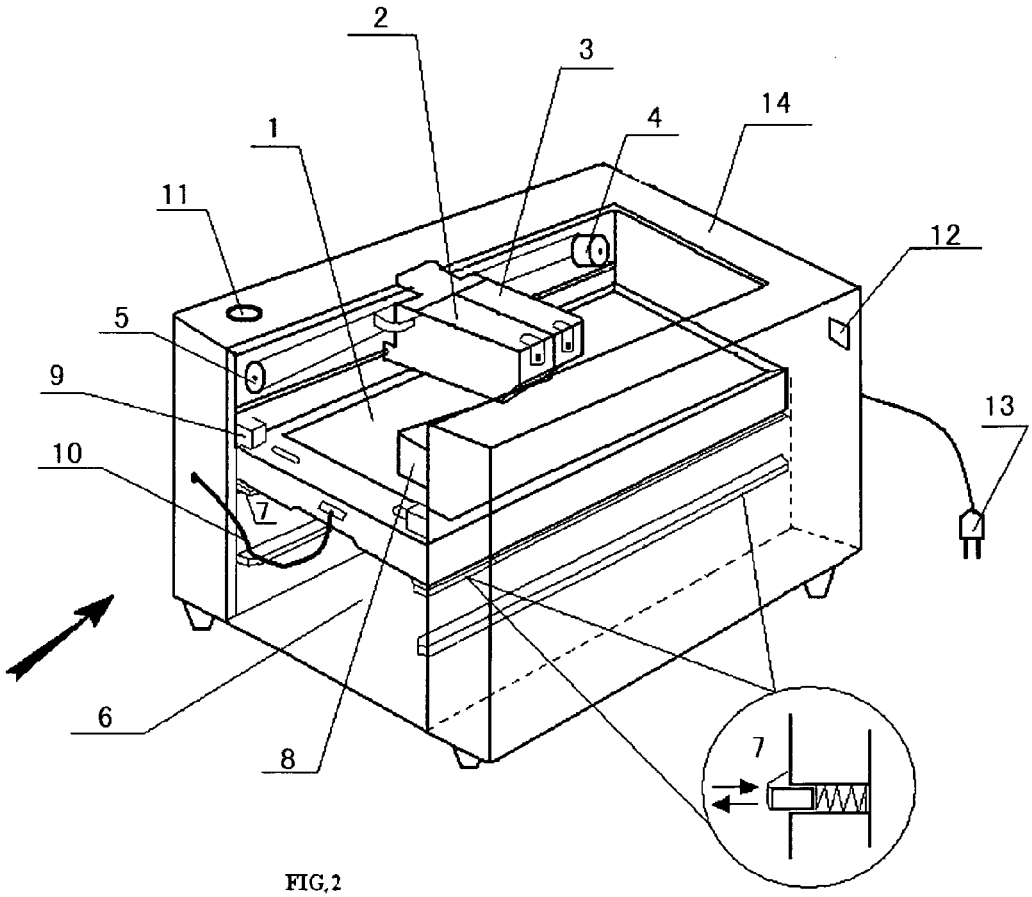
FIG. 2 shows a representation of a portable type printer in accordance with the invention.

FIG. 2 shows a representation of the designated portable type printer 14 for the PB Reader. On the top section of the printer there are two ink cartridges: one cartridge is color ink 2 and the other contains black ink 3. The printer also involves a cartridge drive motor 4 and a cartridge move belt 5.

When printing, the user (1) inserts the PB Reader 1 equipped with a blank paper-belt roll into the "printing center receptacle space" 6 on the tracks 7. (2) Connects the printing cable line 10 between the printer and the PB reader 1. The printing center receptacle space 6 is designed as multi-layer space combined with the flexible tracks 7 which have springs behind them in order to go in and out to accommodate the different thickness of the PB Reader 1. (Please see the amplified drawing on the bottom right side). The operating method of the printer is the same as other printers on the market today.

There is also a mini, electric calorifier/dryer 8 installed in the printer 14 to dry the paper while paper rolls through the PB Reader. The position-fasten control equipment 9 will keep the PB Reader 1 in a fixed position for printing.

The portable type printer 14 has a USB jack 12, a power switch 11 and a power plug 13.

Figure 3:
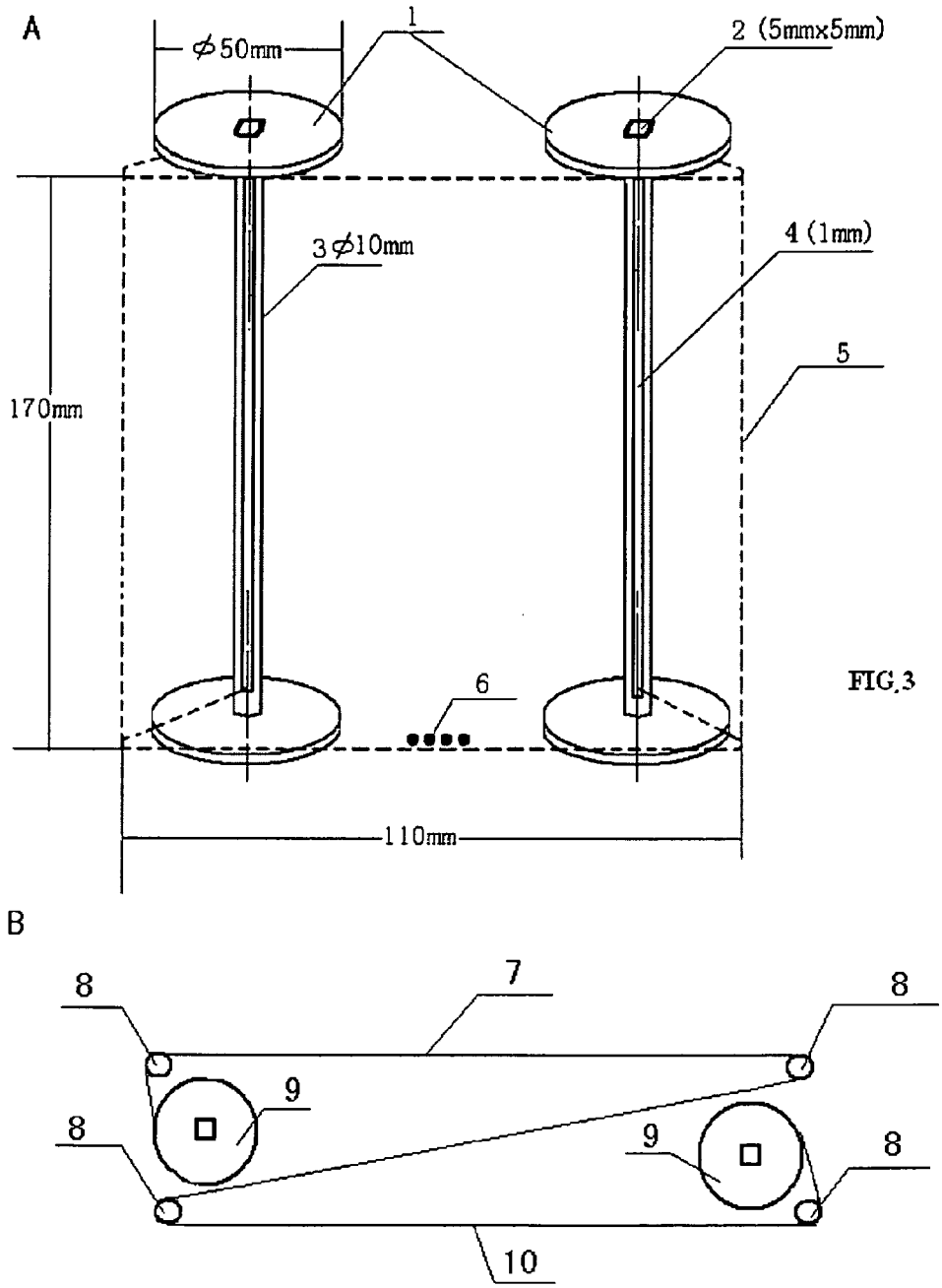
FIG. 3 shows a representation of a paper-belt roll structure with suggested measurements in accordance with the invention.

FIG. 3 shows a representation sample of a detailed drawing of the mechanical principle of the PB Reader with suggested measurements.

Drawing A. The two paper-belt rollers 1 of the PB Reader are made of plastic, containing a slot 4 in each of the intermediate spindles 3 to connect the lead of the paper belt 5. The code 6 contains the round dots are printed on the bottom edge of the paper belt.

The two square holes 2 on the paper-belt rollers 1 are connected to passive axles on the rear cover.

The paper-belt rollers 1, each has a diameter of 50 mm (≈1.97 inches). The special paper is 0.10 mm (≈00.004 inches) thick. The total length of the rolled paper on the belts is 25 meters (≈82 feet). The maximum viewing range of the paper is 110 mm (≈4.33 inches), which will make 227 pages (25000/110=227). If printed with 12-point font, the space of 227 pages can print an approximate total of 153,225 letters (with each page printing 675 letters×227 pages=153,225) or 180 photos. Each single page has a space of 150 mm (≈6 inches)×100 mm (≈4 inches).

The above calculation is an example of the paper-belt for single-side printing and reading. It can also develop into a module II that prints and reads on both side of the paper-belt as shown in drawing B.: Paper-belt front side 7, Roller 8, Paper-belt rollers 9, Paper-belt back side 10.

Figure 4:
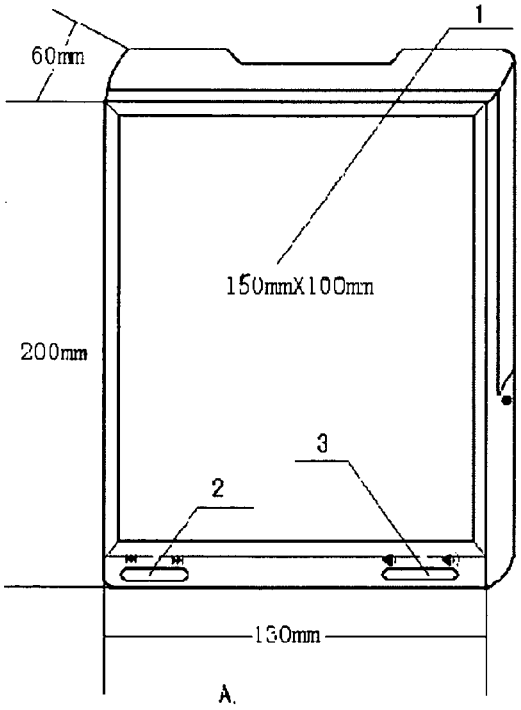
FIG. 4 shows a perspective view of the portable reading device with suggested measurements in accordance with the invention.
Figure 4:
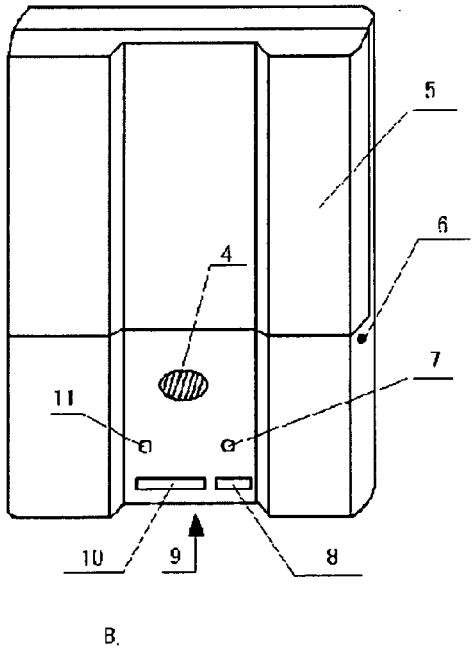

FIG. 4 shows a representation of appearance of the portable type PB Reader in accordance with the invention. Drawing A: Front view and Drawing B: Back view.

On the front side of the PB Reader, the reader's view window 1 is 110 mm (≈4.33 inches)×150 mm (≈6 inches). The reader's page-control buttons (left and right) 2 are used to make the page go forward (right), backward (left) or stop. Continuing to press the page-control buttons 2 causes the paper to go forward (right) or backward (left); pressing once will cause the paper to turn one page forward (right) or backward (left). The volume control buttons 3 are to adjust the volume as necessary (left one for lower volume, right one for higher volume).

On the back side of the reader there is a speaker 4, rear cover 5, USB jack 8, printing jack 9, SDHC Card jack 10, switch 11 and power recharge jack 7.

When opening the rear cover locker 6, the upper rear cover 5 will be opened to expose ⅔ paper rolls to change new paper-belt rolls.

Figure 5:
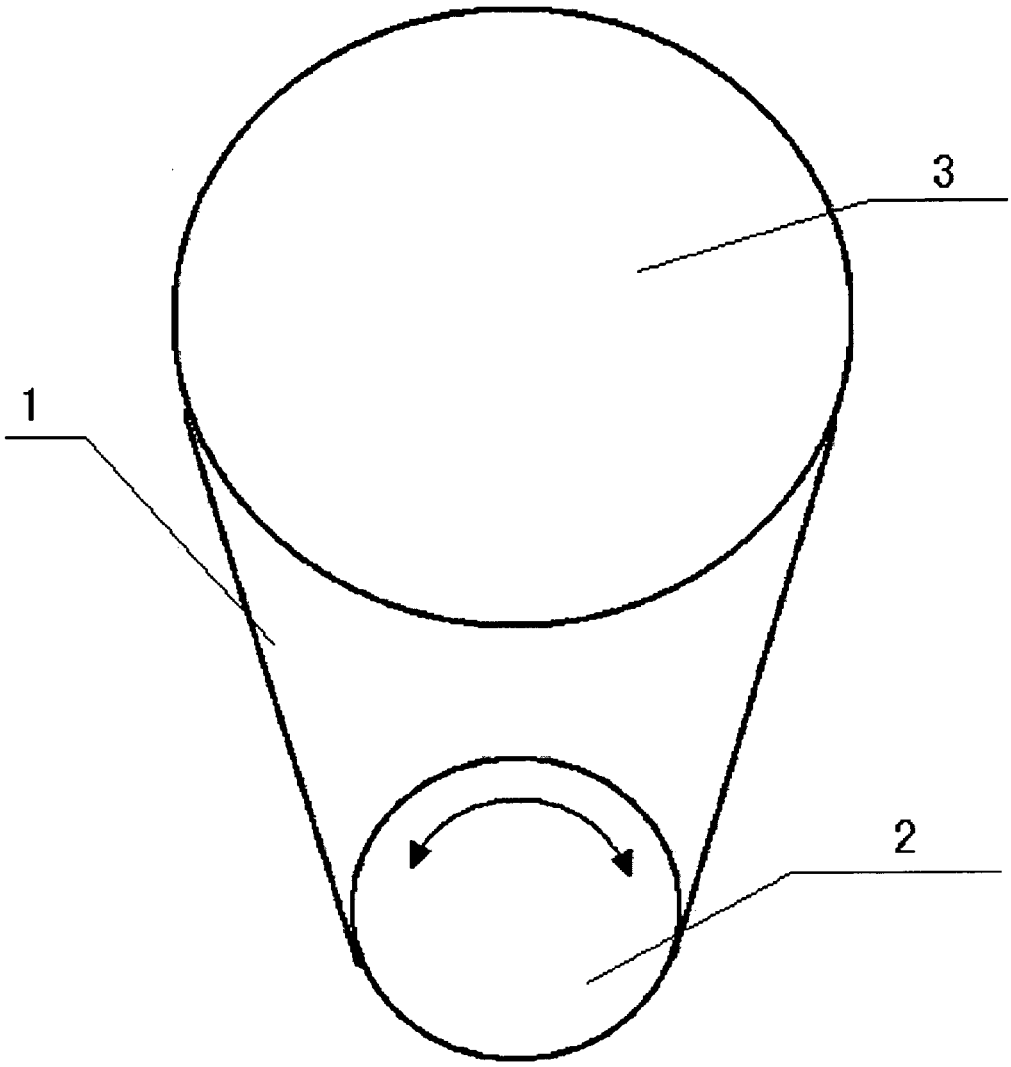
FIG. 5 shows a representation of a remote control wireless device operated by one's heel in accordance with the invention.

FIG. 5 shows a representation of the remote control wireless device 1 operated by one's heel in accordance with the invention. This remote control is controlled by the user's heel, pressing and turning the switch 2, turning it to the left to make pages go backward and turning it to right to make pages go forward. The user will press the heel on the middle of the remote control to stop motion of the paper. Because the switch 2 has springs, it will return to neutral when the user releases pressure from the device.

Figure 6:
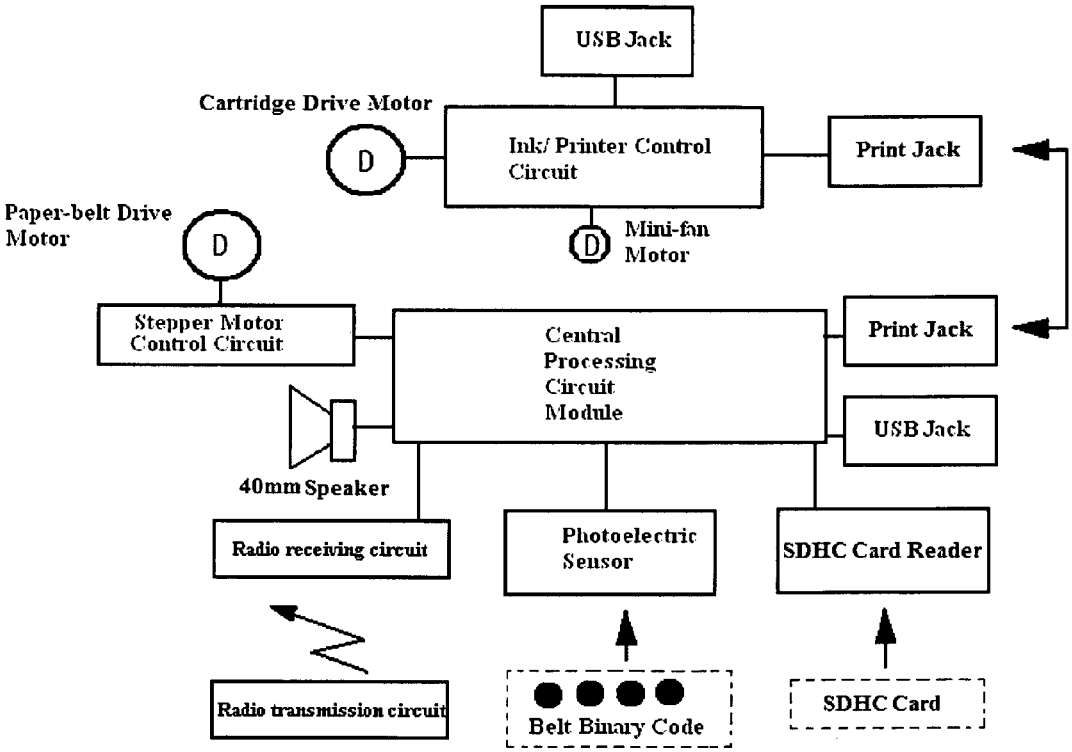
FIG. 6 shows, in block diagram form, the PB Reader's principle electric circuit map in accordance with the invention.

FIG. 6 shows, in block diagram form, the PB Reader's principle electric circuit map in accordance with the invention. The control circuit applies a large-scale integrated circuit (LSI) module. Radio transmission and receiving uses micro-integrated circuit modules (Its operating frequency is 250-300 MHz). The decoder/photoelectric sensor use photoelectric binary sensors. The card reader function allows one to copy or delete files on SDHC card connected to a computer. The processing circuit module includes the following circuits: Encoding circuit, Decoding circuit, Counting circuit, Distribution circuit module, Amplifier module, Switch circuit module and Delay circuit module.

DETAILED DESCRIPTION OF THE INVENTION

The PB Reader solves the problem that the e-reader presents: the e-reader has a non-paper screen and printed documents need assembly, binding, and page turning via hands.

This invention uses special durable paper onto which text is printed. It can provide text-to-speech functions to user for either recreational reading or as a study aid. The page-turning remote control function allows people with disabilities (or people who, for whatever reason, do not have use of their hands) to use the device.

This invention applied two forms of technology:

(1) The PB Reader has the shape of a traditional book. The unit has a viewing window on the front side for reading. The unit is fed by two paper-belt rollers: one on the left side and one on the right side, across which images and text are displayed on the viewing window. The two paper-belt rollers are placed vertically into the back side of the PB Reader by opening the rear cover. Through the rear cover, the paper rolls can be taken off, changed and replaced. The paper scrolls can be stored as traditional books. The paper-belt rolls are also extended to their maximum viewing range when fixed in place by the paper-belt holding board (see FG. 1-9) and left and right roller (see FG. 1-8).

Installed in the device are two sets of paper-roll axles on both the life and right sides. The left side roll axles are used for holding the paper roll (sending paper). The right side roll axles are for receiving the paper.

The ratchet mechanism ensures the left spool will release the holding clip to allow the paper belt to reel to the right, driven by the active square axle powered by the stepper motor. The motion of scrolling the paper-belt rollers is controlled by the encoding dots printed on the bottom edge of the paper belt. This signal input is picked up and interpreted by a decode system which controls the stepper motor.

The said paper belt is made from a special strong paper. The said viewing window does not have any cover, so the reader can read, make underlines/notes and touch the paper belt in order to feel the personal connection and closeness many have with a traditional book.

(2) The second component of this invention is the designated printer. Its body shape is rectangular. The top section of the printer has two ink cartridges; one cartridge is color ink and the other contains black ink. The printer is capable of receiving PB reader of various thicknesses. This is made possible because the tracks on both sides of the printer receptacle area have numerous latches installed in different tiers.

It is ready for printing by connecting the print jack of the PB Reader to the printer's connector cable. The printed text is displayed on the paper roll from left to right on the said PB Reader. There is a mini dryer installed in the printer to dry the paper, which will continuously roll into the PB Reader while printing. This printer represents the following advantages over the common printer used nowadays: (a) the printer won't jam paper; (b) no paper binding will be needed.

There are two methods for using the said PB Reader: (a) one can read the PB Reader by using the ready-printed paper-belt roll in it; (b) one can also place the said PB reader with blank paper-belt roll into the said printing center to print any content one likes from the computer.

The special paper used for the paper belt has the following characteristics: it is thin, light weight, strong, durable and hard to tear. Tyvek Spunbonded olefin sheet products from Dupont Company are good examples of paper that can be used.

This PB Reader has a remote control function. It applies a wireless radio technology by sending radio frequencies (RF). The remote control feature allows various human control interfaces, such as with the foot or chin, allowing the PB reader to be a handicap-friendly device. The PB reader is powered by a 12 V DC lithium battery. The invention-PB Reader has a card reader and a USB jack which can be connected to a computer to download files. The said printer also has a USB jack that can connect to a computer to print. The said printer will come with directions to provide step by step printing instructions (i.e., please insert PB reader in to printer, start to print, printing finished etc. . . . )

The benefits of the said PB Reader unit are (1) Electronic files and documents can be printed continuously on the paper-belt roll. This will allow the user to quickly read and search the documents. It also provides better, safe and long-lasting storage than traditional paper books or paper files because of the special kind of paper that is used.

(2) There is a text-to-speech feature that enables out-loud-reading capabilities or fun reading possibilities with featured background music.

(3) A remote control function provides convenience for people who need this function or any needed occasions.

(4) The printing function of inserting the PB reader into the printer eliminates the need of binding.

The skilled person will understand that references to a document or a file here are to be interpreted broadly and include (but are not limited to) newspapers, books, emails, attachments, web pages, markup language documents, written music, images, and other graphical representations; for example, comics.

The skilled person will understand that a document reading device of the type described above is not restricted to documents in any particular language such as English and may, for example, be used with languages with different script reading and/or page turning directions, such as Arabic, Chinese and Japanese.

It will be understood that the invention is not limited to the described embodiments and encompasses modifications apparent to those skilled in the art lying within the spirit and scope of the claims appended hereto.

What is claimed is:

1. The combination of:

(a) a reader, the reader comprising, (i) a generally rectangular body shaped to define a window, (ii) a printable belt disposed within the body, the belt being adapted for mechanical advancement within the body, a portion of the belt being externally accessible through the window, and (b) a printer electrically and mechanically coupled to the reader in a releasable manner, (c) wherein the printer is adapted to mechanically receive the reader in its assembled form and print directly on the belt through the window in the body.

2. The combination as claimed in claim 1 wherein the printable belt is constructed out of paper.

3. The combination as claimed in claim 2 wherein the printable belt is at least partially wound onto a pair of vertical spools that are disposed entirely within in the body.

4. The combination as claimed in claim 3 wherein the reader further comprises a pair of vertical axles that are rotatably mounted in the body, wherein the pair of vertical spools is retained on the pair of vertical axles.

5. The combination as claimed in claim 4 wherein reader further comprises a gear assembly driven by a motor for mechanically advancing the printable belt within the body.

6. The combination as claimed in claim 5 wherein the gear assembly rotates the pair of vertical axles and the pair of vertical spools mounted thereon in a first direction in order to advance the printable belt within the body.

7. The combination as claimed in claim 6 wherein the reader further comprises a pair of rollers and a board for holding a portion of the printable belt in a taut, flat and smooth manner.

8. The combination as claimed in claim 6 wherein the gear assembly includes a pair of ratchet mechanisms for disengaging the gear assembly from the pair of vertical axles when the gear assembly rotates in a second direction that is opposite to the first direction.

9. The combination as claimed in claim 5 wherein the reader further comprises a wireless remote control for regulating operation of the motor and mechanically advancing the belt within the body.

10. The combination as claimed in claim 1 wherein a code is provided on the printable belt.

11. The combination as claimed in claim 10 wherein the printer includes a photoelectric sensor for detecting the code on the printable belt, thereby allowing for the synchronization of printing by the printer onto the belt of the reader.

12. The combination as claimed in claim 11 wherein the reader further comprises a central processing circuit module that is connected to both the photoelectric sensor and a speaker, wherein the central processing circuit module provides the reader with text-to-speech capabilities by emitting sound from the speaker in response to the photoelectric sensor detecting the code on the printable belt.

13. The combination as claimed in claim 11 wherein the reader further comprises a card reader in connection with the central processing unit, wherein the central processing unit is adapted to receive an audio file from the card reader to provide the reader with text-to-speech capabilities.

14. The combination as claimed in claim 1 wherein the printer is adapted to receive a reader of variable thickness.

15. The combination as claimed in claim 14 wherein the printer includes first and second pairs of opposing tracks that at least partially define first and second reader receiving receptacles.

16. The combination as claimed in claim 15 wherein each of the first pair of opposing tracks is outwardly spring-biased, the first pair of opposing tracks being adapted to be inwardly displaced upon receiving a suitable force thereon to enable the printer to accommodate a reader of variable thickness.

17. The combination as claimed in claim 1 wherein the printer comprises:

(a) at least one cartridge adapted to print a supply of ink on the printable belt, and (b) a motorized fan that is directed towards the window of the reader in order to dry the supply of ink printed on the printable belt.

* * * * *